US010439297B2

(12) United States Patent
Topak et al.

(10) Patent No.: US 10,439,297 B2
(45) Date of Patent: Oct. 8, 2019

(54) PLANAR ANTENNA ARRAY

(71) Applicant: Sony Corporation, Tokyo (JP)

(72) Inventors: Ali Eray Topak, Stuttgart (DE); Arndt Thomas Ott, Stuttgart (DE); Ramona Hotopan, Stuttgart (DE)

(73) Assignee: SONY CORPORATION, Tokyo (JP)

( * ) Notice: Subject to any disclaimer, the term of this patent is extended or adjusted under 35 U.S.C. 154(b) by 140 days.

(21) Appl. No.: 15/594,984

(22) Filed: May 15, 2017

(65) Prior Publication Data

US 2017/0365933 A1 Dec. 21, 2017

(30) Foreign Application Priority Data

Jun. 16, 2016 (EP) ..... 16174792

(51) Int. Cl.

| | |
|---|---|
| ***H01Q 5/00*** | (2015.01) |
| ***H01Q 21/06*** | (2006.01) |
| ***H01Q 21/00*** | (2006.01) |
| ***H01Q 1/32*** | (2006.01) |
| ***H01Q 3/26*** | (2006.01) |

(52) U.S. Cl.

CPC ..... *H01Q 21/061* (2013.01); *H01Q 1/3233* (2013.01); *H01Q 3/26* (2013.01); *H01Q 21/005* (2013.01); *H01Q 21/0075* (2013.01); *H01Q 21/064* (2013.01); *H01Q 21/065* (2013.01)

(58) Field of Classification Search

None

See application file for complete search history.

(56) References Cited

U.S. PATENT DOCUMENTS

| | | | | |
|---|---|---|---|---|
| 3,078,463 | A | 2/1963 | Lamy | |
| 4,347,516 | A | 8/1982 | Shrekenhamer | |
| 4,730,193 | A * | 3/1988 | Schwartz | H01Q 17/001 343/700 MS |
| 4,937,585 | A | 6/1990 | Shoemaker | |
| 5,512,906 | A | 4/1996 | Speciale | |
| 6,147,658 | A * | 11/2000 | Higashi | H01Q 3/12 333/167 |
| 6,175,723 | B1 * | 1/2001 | Rothwell, III | H01Q 3/24 342/359 |
| 8,604,989 | B1 | 12/2013 | Olsen | |
| 2005/0164664 | A1 * | 7/2005 | DiFonzo | H04L 45/00 455/277.1 |

(Continued)

FOREIGN PATENT DOCUMENTS

| | | |
|---|---|---|
| DE | 10 2014 212 494 A1 | 12/2015 |
| GB | 2 243 491 A | 10/1991 |

OTHER PUBLICATIONS

Extended European Search Report dated Nov. 6, 2017 in Patent Application No. 17176389.9.

(Continued)

*Primary Examiner* — Trinh V Dinh

(74) *Attorney, Agent, or Firm* — Xsensus LLP

(57) ABSTRACT

A planar antenna array comprises two or more linear arrays of radiation elements, said linear arrays being substantially arranged in parallel, a first connecting unit connecting first ends of said two or more linear arrays, a second connecting unit connecting second ends of said two or more linear arrays, and a feed port at least at one end of each one of said first and second connecting units for reception of a feed signal.

16 Claims, 9 Drawing Sheets

(56) References Cited

U.S. PATENT DOCUMENTS

| | | | | |
|---|---|---|---|---|
| 2008/0080364 | A1* | 4/2008 | Barak | H04B 7/0408 370/210 |
| 2009/0066597 | A1 | 3/2009 | Yang et al. | |
| 2010/0060521 | A1 | 3/2010 | Hayes et al. | |
| 2013/0201060 | A1 | 8/2013 | Livneh et al. | |
| 2014/0306846 | A1* | 10/2014 | Nakatsu | H01Q 21/0075 343/700 MS |
| 2015/0155636 | A1* | 6/2015 | Maruyama | H01Q 19/30 343/730 |
| 2015/0325926 | A1 | 11/2015 | Topak et al. | |
| 2015/0349422 | A1 | 12/2015 | Klemes | |
| 2016/0036135 | A1 | 2/2016 | Hellinger et al. | |
| 2016/0141754 | A1 | 5/2016 | Leyh et al. | |
| 2017/0133757 | A1 | 5/2017 | Hasch | |
| 2018/0358706 | A1* | 12/2018 | Kildal | H01Q 9/26 |

OTHER PUBLICATIONS

European Office Action dated Aug. 9, 2018 in European Application No. 17176389.9-1205.

Ahmed Abdellatif et al: "Novel low cost compact phased array antenna for millimeter-wave 3D beam scanning applications", 2013 IEEE Antennas and Propagation Society International Symposium (APSURSI), Jul. 1, 2014 (Jul. 1, 2014), pp. 1145-1146.

Mohsen Khalily et al: "Design of Phased Arrays of Series-Fed Patch Antennas With Reduced Number of the Controllers for 28-GHz mm-Wave Applications", IEEE Antennas and Wireless Propagation Letters, vol. 15, Dec. 4, 2015 (Dec. 4, 2015), pp. 1305-1308.

Levente Dudas et al. "Digital Beamforming 2D Antenna for X-band," ATKAAF 49(1-2), ISSN 0005-1144, 2008, pp. 9.

Rafael H. Medina-Sanchez "Beam Steering Control System for Low-Cost Phased Array Weather Radars: Design and Calibration Techniques," Doctoral Dissertations 2014-current, 2013, pp. 220.

S.Shynu et al. "Reconfigurable Antenna with Elevation and Azimuth Beam Switching." IEEE Antennas and Wireless Propagation Letters, vol. 9, DOI: 10.1109/LAWP.2010.2049332, 2010, pp. 5.

* cited by examiner

PLANAR ANTENNA ARRAY

BACKGROUND

Field of the Disclosure

The present disclosure relates to a planar antenna array, an antenna device and a method of operating such an antenna array.

Description of Related Art

Recently, 2D electronic beamforming systems are becoming more popular for consumer-type radar and communication products. Phased arrays are an interesting beamforming technique, used for shaping and steering the main antenna beam electronically to certain directions within the predefined field of view. The phased array technology has been the key antenna system for satellite communications and military radar for decades. However, despite its high functional performance, it is still a very costly and complex solution for emerging wireless consumer applications such as high speed wireless communication and driving assistance systems due to the number of phase shifter, variable gain amplifier and their complex control circuitry for dynamic calibration.

Current automotive radar manufacturers would like to bring more functionality to their products, such as 2D electronic beamforming in elevation and azimuth. Alternatively, multi-mode radar products are attracting much more attention of the customers, which is used for multiple purposes at the same time.

The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present disclosure.

SUMMARY

It is an object to provide a planar antenna array, an antenna device and a method of operating such an antenna array, which enable 2D beamforming.

According to an aspect there is provided a planar antenna array is presented comprising:

- two or more linear arrays of radiation elements, said linear arrays being substantially arranged in parallel and connected each other using serial feed network from both sides,
- a first connecting unit connecting first ends of said two or more linear arrays,
- a second connecting unit connecting second ends of said two or more linear arrays, and
- a feed port at least at one end of each one of said first and second connecting units for reception of a feed signal.

According to a further aspect there is provided an antenna device comprising:

- a planar antenna array as disclosed herein, and
- a signal source for generating a feed signal and for providing said feed signal to said feed ports.

According to further aspect there is provided a method of operating an antenna array comprising:

- generating a feed signal,
- providing said feed signal to one or more feed ports of said antenna array, thereby controlling to which of said feed ports the feed signal is provided and controlling the phase of the feed signal before providing it to said one or more feed ports.

Embodiments of the invention are defined in the dependent claims. It shall be understood that the claimed method and antenna device have similar and/or identical preferred embodiments as the claimed antenna array, in particular as defined in the dependent claims and as disclosed herein.

One of the aspects of the disclosure is to provide a planar antenna array that enables the superposition of two or more (e.g. four) squinted antenna beams caused by two or more feed signals, as exciting signals, that are simultaneously provided to the different feed ports. By controlling these feed signals many different antenna beams can be achieved so that the antenna beam can be steered to several directions in elevation and azimuth electronically The disclosed 2D planar antenna topology can be used as transceiver, transmitter or receiver antenna.

Optionally, a variable phase shifter may be provided at each feed port, but additional variable gain amplifiers are generally not required.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
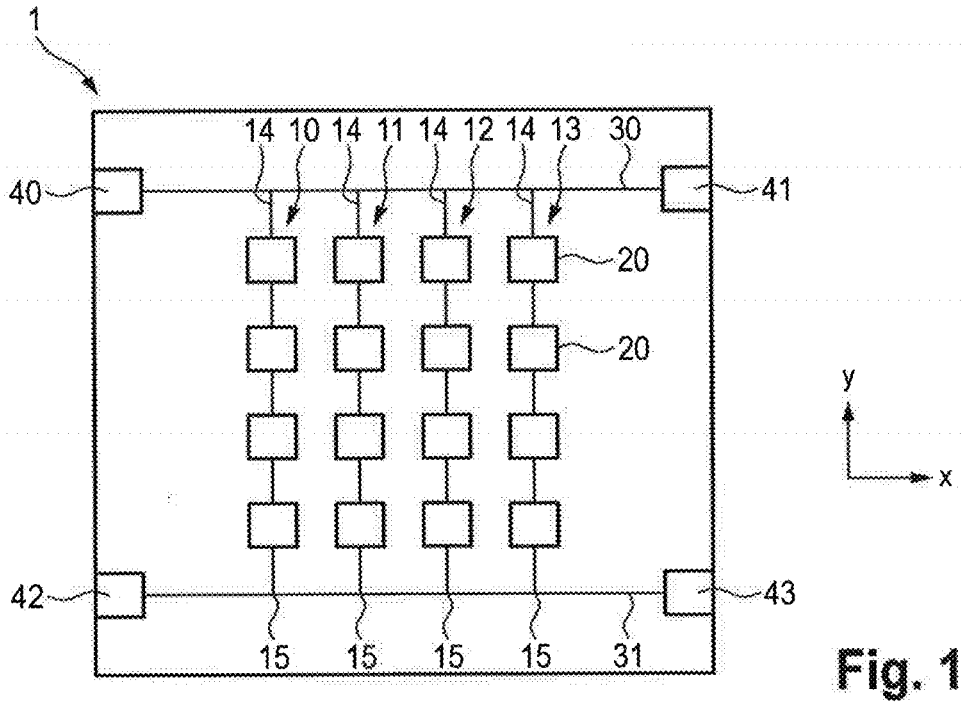
FIG. 1 shows a top view of a first embodiment of a planar antenna array according to the present disclosure.

Referring now to the drawings, wherein like reference numerals designate identical or corresponding parts throughout the several views, FIG. 1 shows FIG. 1 shows a top view of a first embodiment of a planar antenna array 1 according to the present disclosure. It comprises four linear arrays 10, 11, 12, 13 of radiation elements 20. The linear arrays 10, 11, 12, 13 are substantially arranged in parallel and each comprise, in this embodiment, four radiation elements 20. A first connecting line 30, as an embodiment of a first connecting unit, connects first ends 14 of said linear arrays 10, 11, 12, 13. A second connecting line 31, as an embodiment of a second connecting unit, connects second ends 15 of said linear arrays 10, 11, 12, 13. Feed ports 40, 41, 42, 43 are provided at each end 32, 33, 34, 35 of each one of said first and second connecting lines 30, 31 for reception of a respective feed signal. This 2D planar antenna array 1 can be used for steering the generated antenna beam to several directions in elevation and azimuth electronically.

The radiation elements may be configured as patch antenna elements (e.g. placed on an RF substrate) or slotted waveguides (or a waveguide array) (e.g. as hollow metallic waveguides) or SIW (substrate-integrated-waveguide, e.g. placed on an RF substrate) type slot arrays, which are some of the antenna topologies, which can be used for this cross-shape architecture. This antenna topology does not have isolation problems due to enough spacing among the feed ports.

Figure 2:
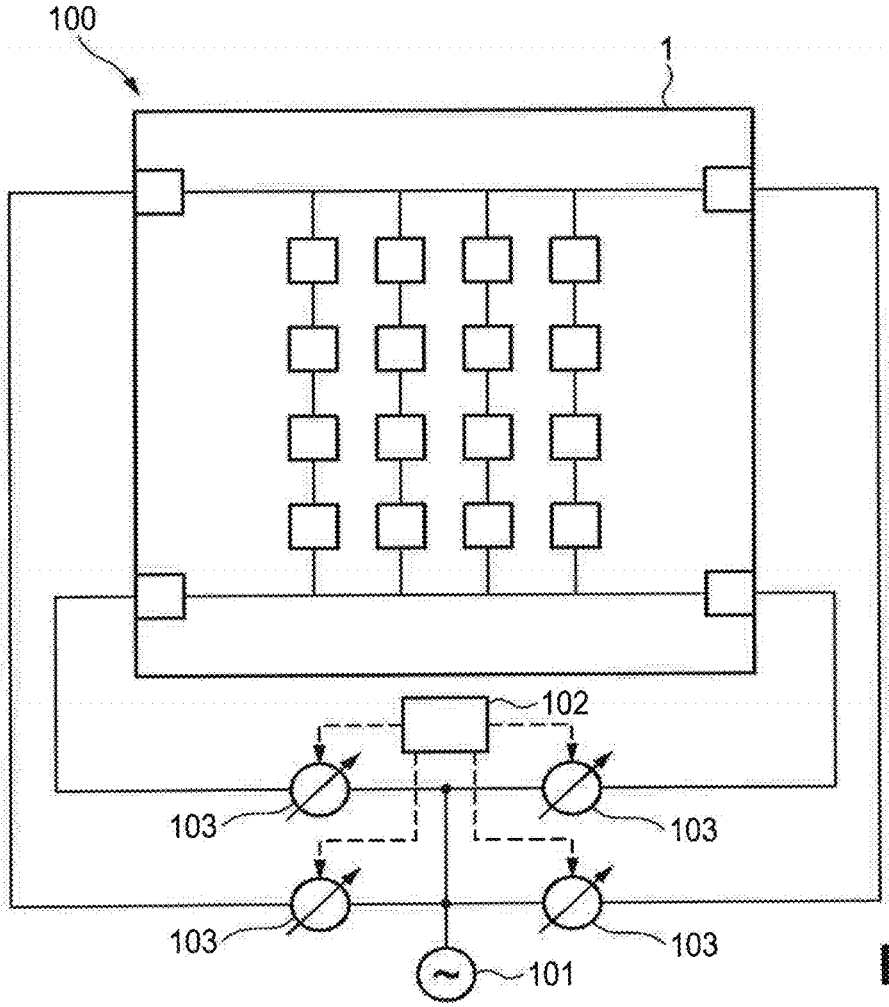
FIG. 2 shows an embodiment of an antenna device according to the present disclosure.

FIG. 2 shows an embodiment of an antenna device 100 according to the present disclosure. It comprises a planar antenna array as disclosed herein, e.g. the antenna array 1 as shown in FIG. 1, and a signal source 101, e.g. a controllable oscillator, for generating a feed signal and for providing said feed signal to said feed ports 40, 41, 42, 43.

In order to steer the antenna beam to different directions, these ports can in one embodiment individually be turned on and off (e.g. digitally), or it can be controlled to which of the feed ports 40, 41, 42, 43 (e.g. to only one, or two, or three, or all) the feed signal is provided. For this purpose, the antenna device 100 may optionally comprise a controller 102.

Further, it may optionally be possible to switch the input phases of the feed ports, preferably at least between 0° and 180°. For example, current commercial radar front-ends are capable of providing these properties on a chip level. For this purpose, the antenna device 100 may optionally further comprise a variable phase shifter 103 at one or more feed ports 40, 41, 42, 43. The variable phase shifter(s) 103 may also be controlled by the controller 102 or a separate controller. Generally, the variable phase shifter(s) 103 may be configured to control the input phases of the feed ports to any phase value between 0° and 360°, thus providing even more flexibility in the two-dimensional direction control of the resulting antenna beam.

It is thus possible in an embodiment to control (e.g. by the controller 102) to which of said feed ports the feed signal is provided and/or which of the feed ports 40, 41, 42, 43 is switched on and which is switch off. Further, by use of e.g. the controller 102 it may be possible to control the phase of the feed signal before providing it to said one or more feed ports 40, 41, 42, 43.

Figure 3:
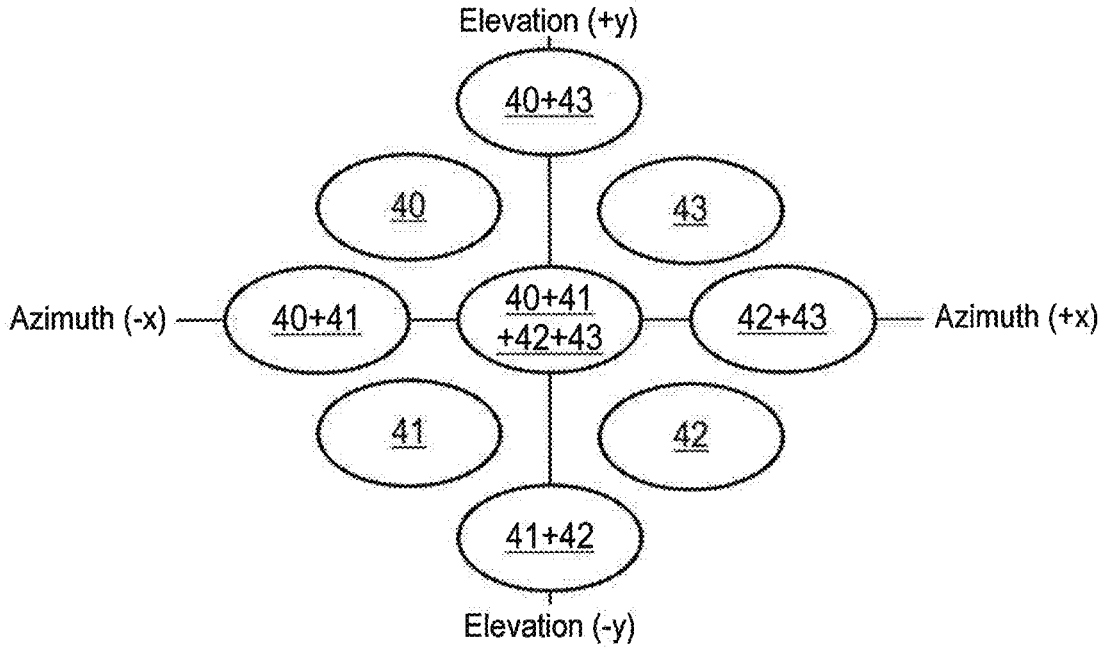
FIG. 3 shows a diagram illustrating the direction of the main beam based on which feed ports are active or are provided with a feed signal.

FIG. 3 shows a diagram illustrating the direction of the main antenna beam based on from which feed port(s) 40-43 the feed signal is fed. The numbers in the different fields indicate which feed ports are simultaneously switched on or to which feed ports the feed signal is simultaneously provided.

Figure 4:
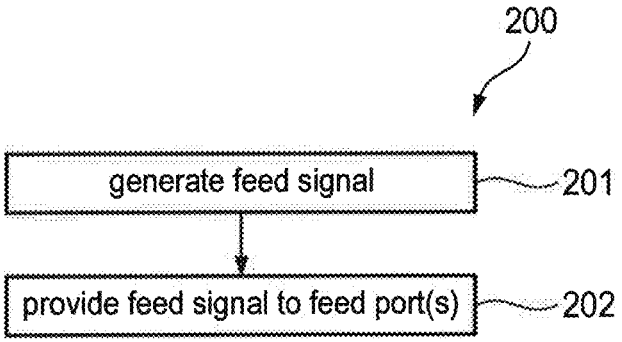
FIG. 4 shows a flow chart of a method according to the present disclosure.

FIG. 4 shows a flow chart of a method 200 according to the present disclosure. In a first step 201 a feed signal is generated. In a second step 202 said feed signal is provided to one or more feed ports of said antenna array, thereby controlling to which of said feed ports the feed signal is provided and controlling the phase of the feed signal before providing it to said one or more feed ports.

Figure 5:
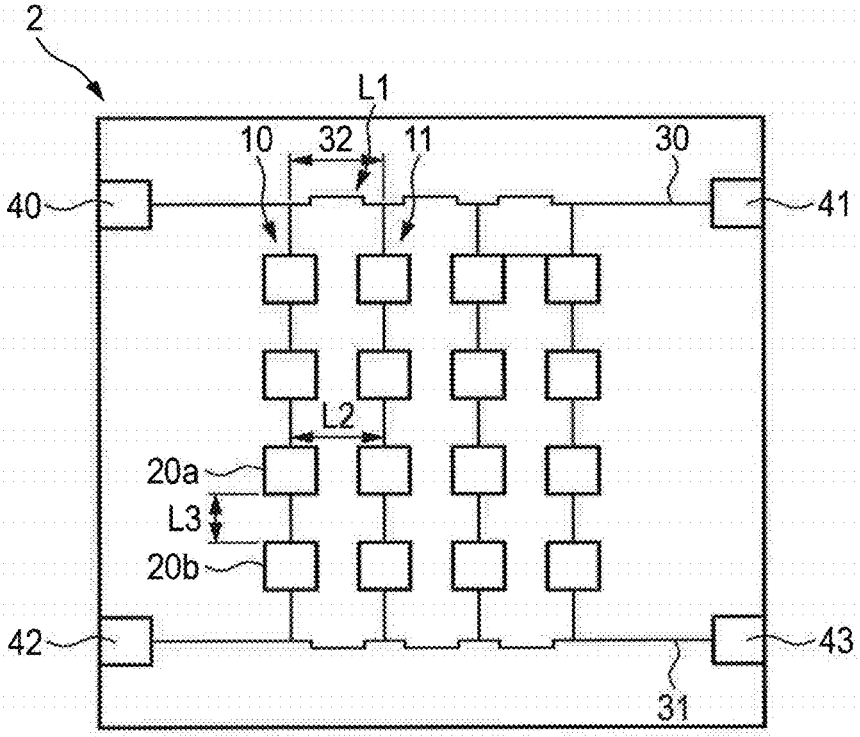
FIG. 5 shows a top view of a second embodiment of a planar antenna array according to the present disclosure.

FIG. 5 shows a top view of a second embodiment of a planar antenna array 2 according to the present disclosure. This embodiment is rather similar to the embodiment of the planar antenna array 1 shown in FIG. 1. However, the various lengths and spacings may be individually designed and are partly different than in the embodiment of the planar antenna array 1.

In particular, the length L1 of the connecting line portion 32 between two neighboring linear arrays, e.g. between the linear arrays 10, 11, is larger than the spacing L2 between said two neighboring linear arrays 10, 11, as can be seen from the fact that the connecting line portion 32 is not a straight line, but a part of meander (it may also have a different form, e.g. curved, as long as then length is increased compared to a straight line). The length L2 may hereby be identical for all connecting line portions between each pairs of neighboring linear arrays, both in the connecting line 30 and the connecting line 31. In other embodiments the values of the lengths L1 can be different for different pairs of neighboring linear arrays.

The length L1 of the connecting line portion 32 between two neighboring linear arrays 10, 11 is particularly designed to determine the distribution of phase and/or amplitude values for said two neighboring linear arrays 10, 11 and particularly has an influence on the beam steering in ±x (i.e. azimuth) directions. If the electrical length L1 is half wavelength, there will be no beam steering, but the beam will look to the 0° direction. If this spacing is smaller than half wavelength, the beam will look to the +x direction. If this spacing is longer that half wavelength, the beam will look to the −x direction. Hence, adjustment of input phases causes a beam steering in a final radiation pattern.

The spacing L2 between two neighboring linear arrays, e.g. between the linear arrays 10, 11, is designed to determine the beam width, side lobes and/or directivity of the antenna beam of the antenna array. The larger the spacing L2 is between linear arrays, the narrower the beam width is and the larger the side lobes are.

The spacing L3 between two neighboring radiation elements, e.g. the radiation elements 20*a*, 20*b*, of a linear array, e.g. the linear array 10, is designed to determine the beam steering of the antenna beam of the antenna array in a direction parallel to the linear array, i.e. in ±y (i.e. elevation) directions. The larger the spacing L3 is between linear arrays, the narrower the beam width is and the larger the side lobes are If x direction refers to azimuth and y direction refers to elevation, the antenna beam can be steered to multiple different directions. Using the disclosed planar array antenna configuration, the antenna beam can be tilted to many directions. If electromagnetic signals (i.e. feed signals) are supplied from different feed ports with an additional 180° phase shift values, many different beams can be obtained including dual or quad-antenna beams or broadside beams with different half power beam widths (HPBW). If the feed signal is provided to more than one feed port, the superposition of the individual antenna beams (resulting from each individual feed signals provided to a single feed port) is observed as a final antenna beam.

Figure 6:
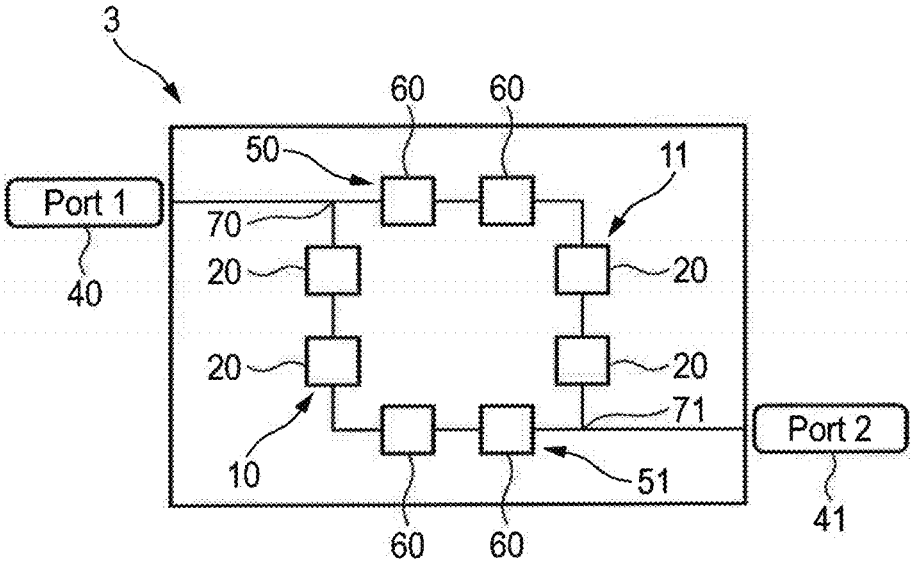
FIG. 6 shows a top view of a third embodiment of a planar antenna array according to the present disclosure.

FIG. 6 shows a top view of a third embodiment of a planar antenna array 3 according to the present disclosure. In this embodiment said first connecting unit comprises, instead of the first connecting line 30 as in the first and second embodiments, a first linear connecting array 50 of radiation elements (in this example two) 60 and said second connecting unit comprises, instead of the second connecting line 31 as in the first and second embodiments, a second linear connecting array 51 of (in this example two) radiation elements 60. Further, there are only two linear arrays 10, 11 of (in this example two) radiation element 20 provided. The first and second linear connecting arrays 50, 51 are arranged substantially perpendicular to said two linear arrays 10, 11, which together form a square.

Further, in this embodiment only two feed ports 40, 41 are provided, one at the feed line to the first intersection 70 between the linear array 10 and the linear connecting array 50 and another one at the feed line to the second intersection 71 between the linear array 11 and the linear connecting array 51.

Generally, there may be more than two (e.g. four) linear arrays. Further, said first and second linear connecting arrays 50, 51 may generally comprise at least one radiation element 60 between each two neighboring linear arrays. Still further, there may be more than two (e.g. four) feed ports.

Figure 7:
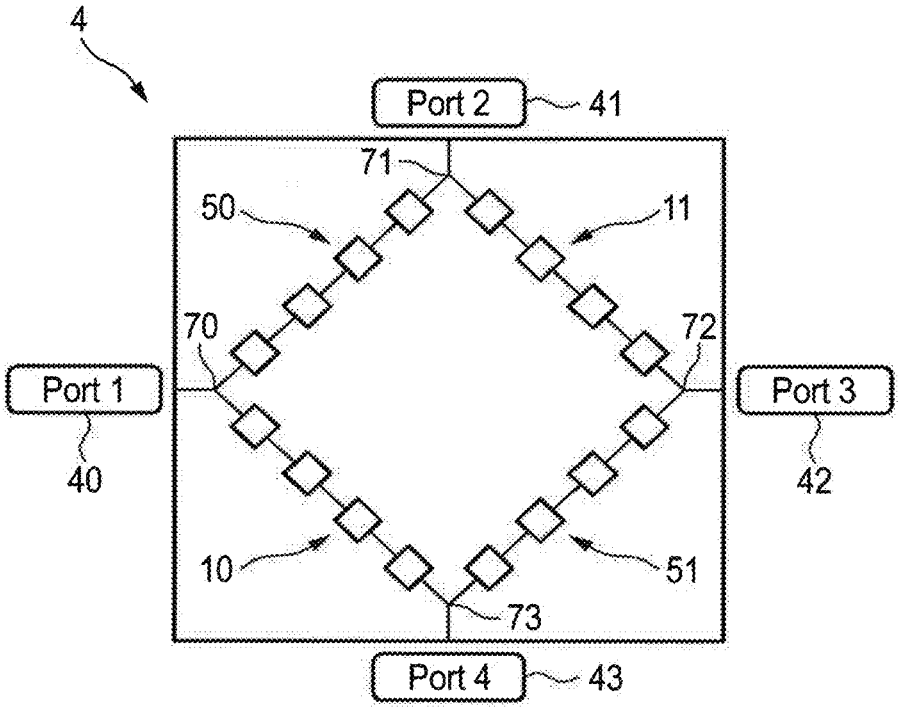
FIG. 7 shows a top view of a fourth embodiment of a planar antenna array according to the present disclosure.

FIG. 7 shows a top view of a fourth embodiment of a planar antenna array 4 according to the present disclosure. This antenna array 4 provides a rhombic antenna topology with two linear arrays 10, 11, two linear connecting arrays 50, 51 and four feed ports 40-43 at the intersections 70-73 of two neighboring arrays.

Figure 8:
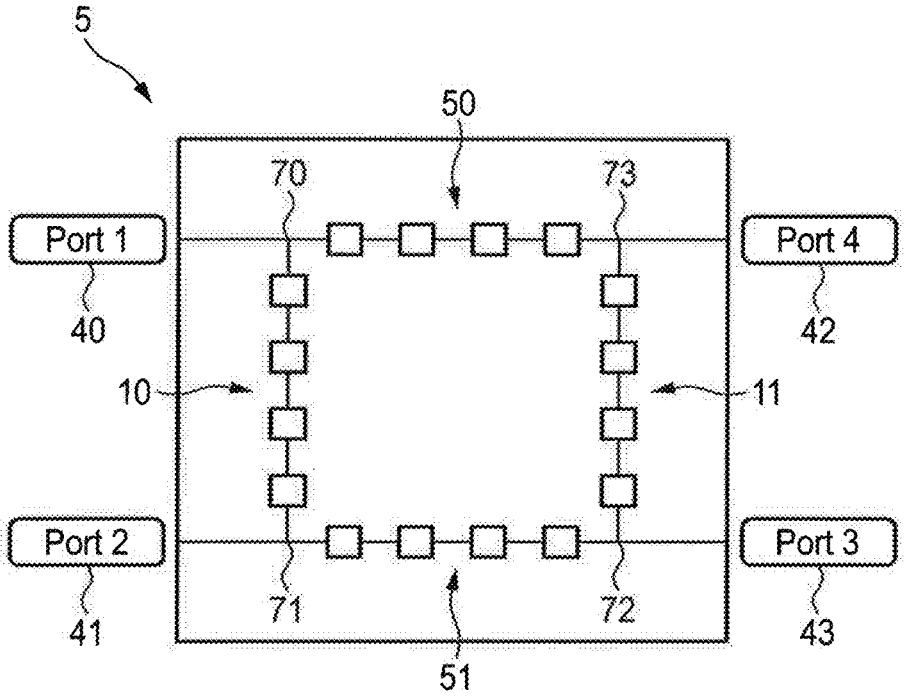
FIG. 8 shows a top view of a fifth embodiment of a planar antenna array according to the present disclosure.

FIG. 8 shows a top view of a fifth embodiment of a planar antenna array 5 according to the present disclosure. This antenna array 5 provides a rectangular antenna topology with two linear arrays 10, 11, two linear connecting arrays 50, 51 and four feed ports 40-43 at the intersections 70-73 of two neighboring arrays. Compared to the antenna array 4 shown in FIG. 7 the antenna array 5 generates an antenna beam that is rotated by 45° compared to the antenna beam generated by the antenna array 4.

Figure 9:
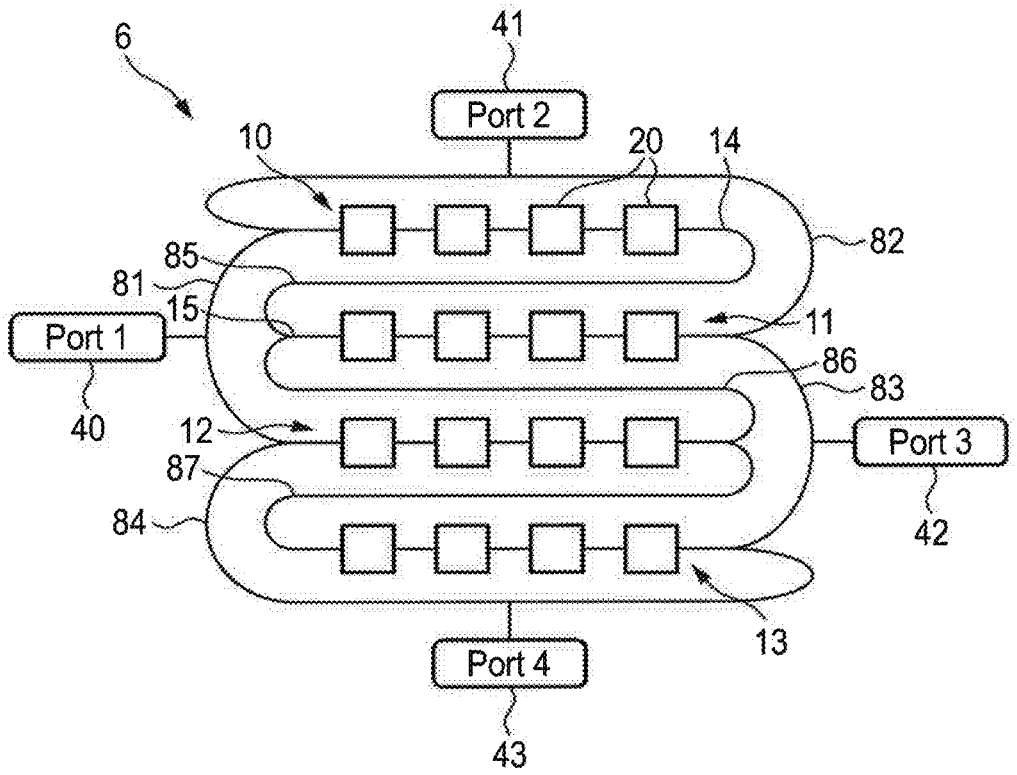
FIG. 9 shows a top view of a sixth embodiment of a planar antenna array according to the present disclosure.

FIG. 9 shows a top view of a sixth embodiment of a planar antenna array 6 according to the present disclosure. This embodiment comprises at least three (in this example four) linear arrays 10, 11, 12, 13 of (in this example four) radiation elements 20. These linear arrays are connected in star topology, i.e. all antenna elements are connected to a feeding port on one side and on the other side all antenna elements are connected together. For this purpose connecting lines 81, 82, 83, 84 are provided, as first and second connecting units, for connecting the linear arrays 10, 11, 12, 13. Further, interconnection lines 85, 86, 87 are provided for interconnecting a first end of a linear array, e.g. first end 14 of linear array 10, with a second end of the neighboring linear array, e.g. second end 15 of linear array 11

The antenna array 6 in star topology has substantially the same beam steering capabilities as the antenna topology shown in FIG. 5 (x-direction, y-direction, 45° direction, and multi-beam capability). However, other properties with respect to beam width and directivity are achieved employing the same board size. Hence, based on a certain application, an antenna topology may be used that fits better to the application.

The functionality of the disclosed planar array topology has been proven through simulation. The planar array topology is not restricted to densely populated planar arrays, to certain numbers of linear array or radiation elements per array. Generally, many different antenna topologies can be employed for 2D beam steering.

This disclosed antenna topology provides that, contrary to conventional phased antenna arrays, it is not sensitive but very robust to operating frequency (e.g. approx. 1 GHz) amplitude (e.g. approx. 10%) and phase errors (e.g. approx. ±15°). It allows 2D beamforming in azimuth and elevation directions, using e.g. single, dual or quad antenna beams. Further, it enables the generation of a pencil-shaped antenna beam and, thus, a rather directive antenna. Further, the antenna array can be built rather compact.

Figure 10:
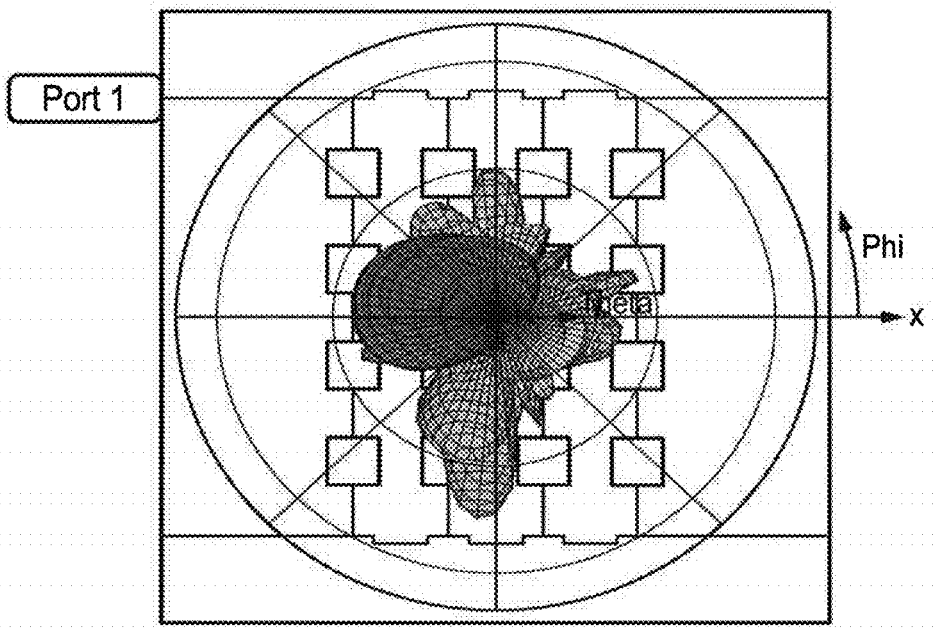
FIGS. 10 to 16 show exemplary antenna beam patterns achievable with the cross-shaped antenna array according to the present disclosure.
Figure 11:
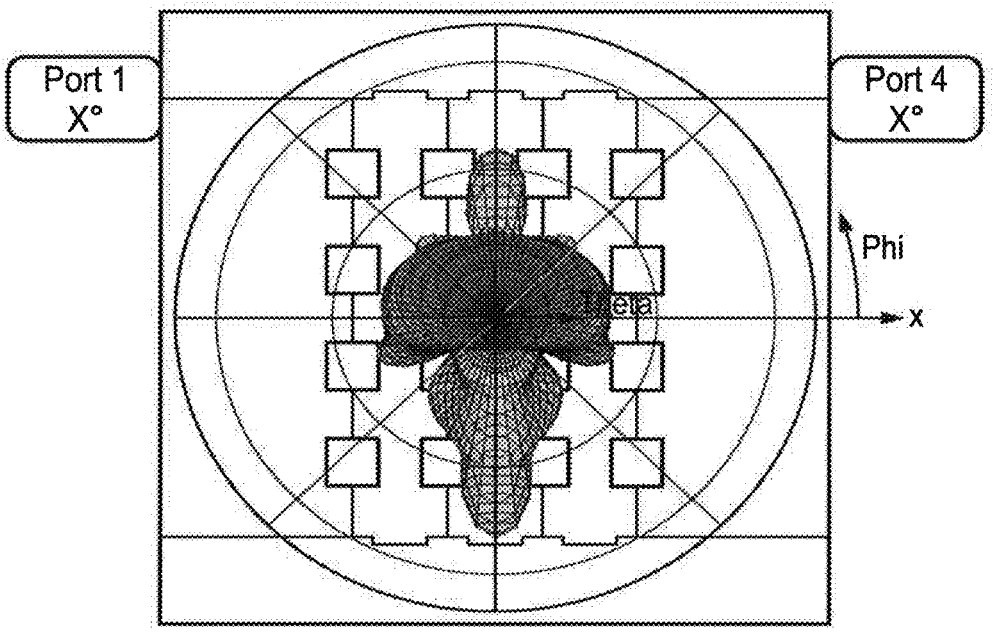
Figure 12:
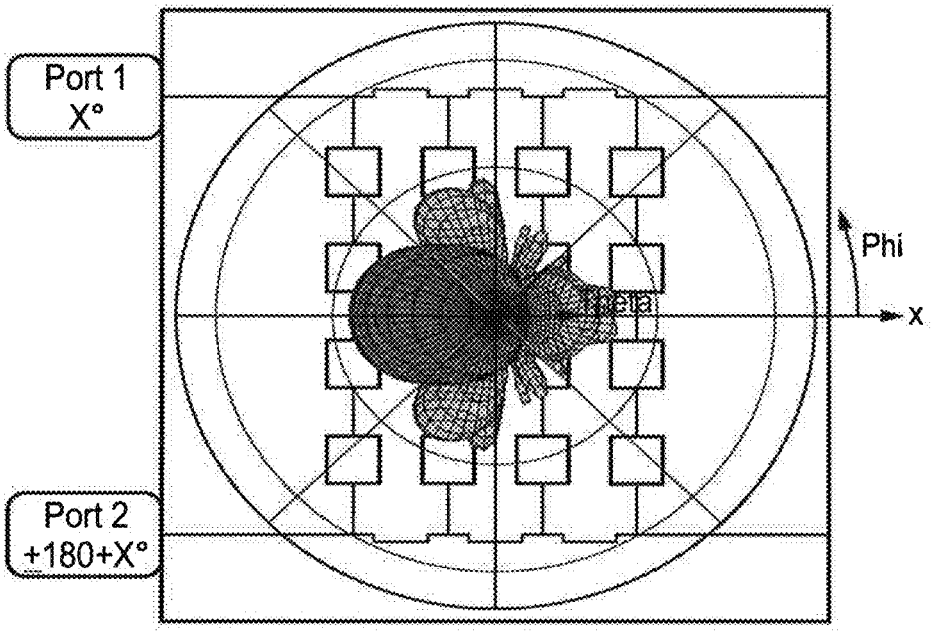
Figure 13:
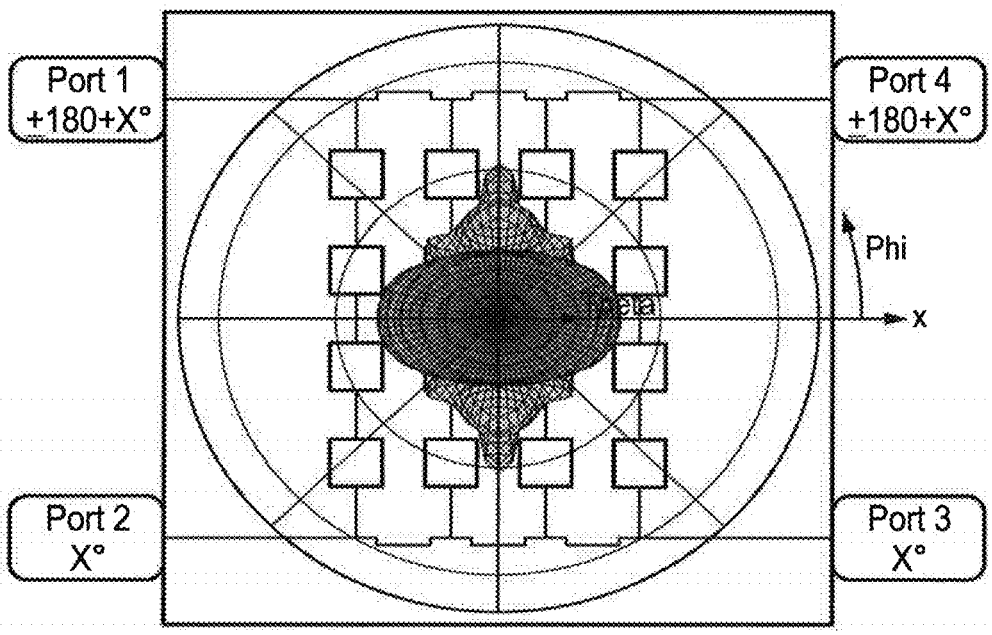
Figure 14:
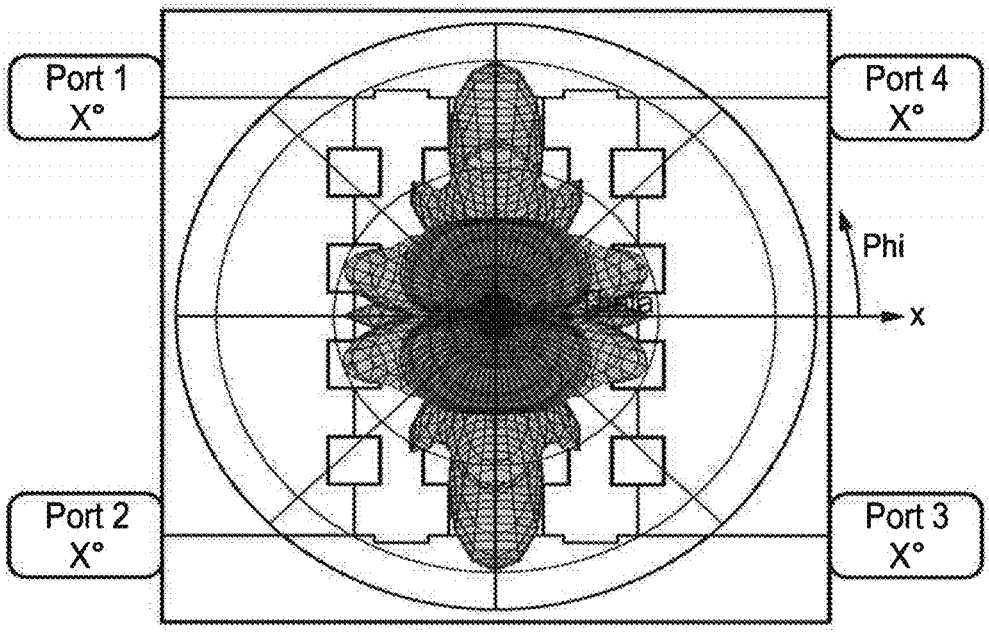
Figure 15:
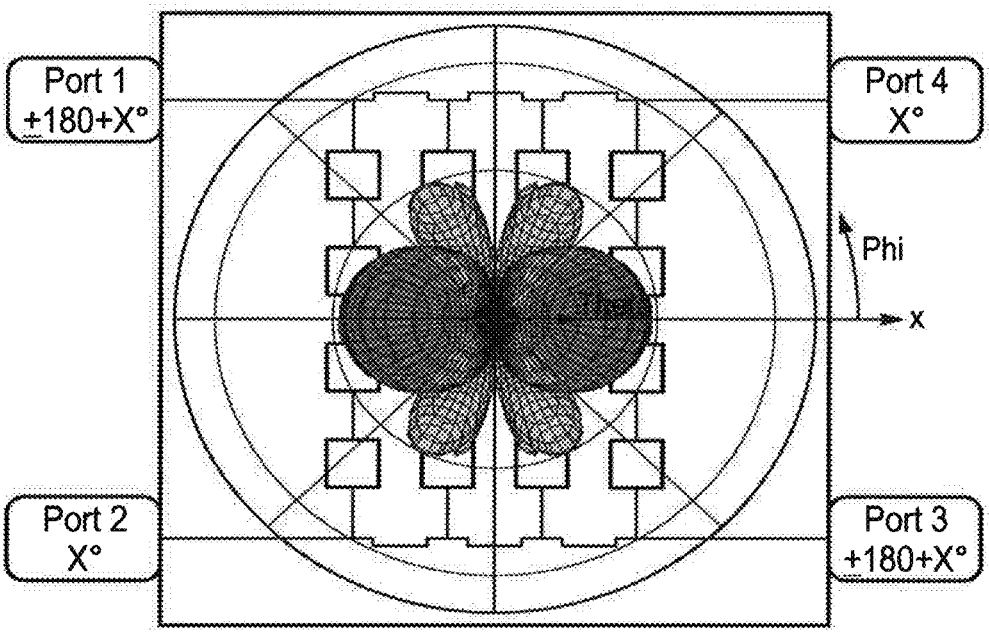
Figure 16:
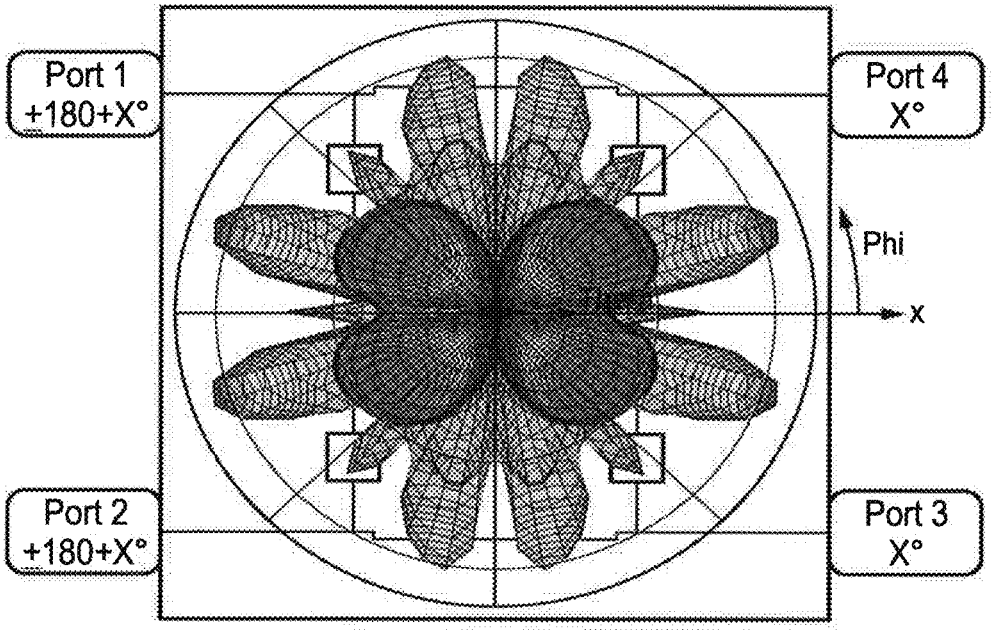

FIGS. 10 to 16 show exemplary antenna beam patterns achievable with the cross-shaped antenna array according to the present disclosure. FIG. 10 shows a −x and +y quarter field antenna beam when port 1 is turned on and the other ports are matched. FIG. 11 shows an antenna beam tilted to +y half field if port 1 and port 4 are turned on at the same time and they have equal input phase and amplitude values and port 2 and port 3 are matched. FIG. 12 shows an antenna beam tilted to −x half field if port 1 and port 2 are turned on and they have equal input amplitude values and 180° phase difference and port 3 and port 4 are matched. FIG. 13 shows a single antenna beam looking to the broadside direction if the signals are fed by port 1, port 2, port 3 and port 4, and the signals fed by all ports have equal amplitudes and ports 2 and 3 have 180° phase difference compared to ports 1 and 4. FIG. 14 shows a dual-beam antenna directed to the −y and +y directions, if the signals fed by all ports have equal amplitude and phase values. FIG. 15 shows a dual-beam antenna directed to the −x and +x directions, if the signals fed by all ports have equal amplitude values, and the difference among the phase values of ports 1 and 3 and ports 2 and 4 should be 180°. FIG. 16 shows a quad-beam antenna directed to different quarter fields, if the signals fed by all ports have equal amplitudes and ports 1 and 2 have 180° phase difference compared to ports 3 and 4; this antenna pattern has a null at the broadside direction.

Thus, the foregoing discussion discloses and describes merely exemplary embodiments of the present disclosure. As will be understood by those skilled in the art, the present disclosure may be embodied in other specific forms without departing from the spirit or essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no inventive subject matter is dedicated to the public.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

In so far as embodiments of the disclosure have been described as being implemented, at least in part, by software-controlled data processing apparatus, it will be appreciated that a non-transitory machine-readable medium carrying such software, such as an optical disk, a magnetic disk, semiconductor memory or the like, is also considered to represent an embodiment of the present disclosure. Further, such a software may also be distributed in other forms, such as via the Internet or other wired or wireless telecommunication systems.

The elements of the disclosed devices, apparatus and systems may be implemented by corresponding hardware and/or software elements, for instance appropriated circuits. A circuit is a structural assemblage of electronic components including conventional circuit elements, integrated circuits including application specific integrated circuits, standard integrated circuits, application specific standard products, and field programmable gate arrays. Further a circuit includes central processing units, graphics processing units, and microprocessors which are programmed or configured according to software code. A circuit does not include pure software, although a circuit includes the above-described hardware executing software.

It follows a list of further embodiments of the disclosed subject matter:

1. A planar antenna array comprising:
   two or more linear arrays (10, 11, 12, 13) of radiation elements (20), said linear arrays being substantially arranged in parallel,
   a first connecting unit (30, 50, 83) connecting first ends (14, 70, 73) of said two or more linear arrays,
   a second connecting unit (31, 51, 81) connecting second ends (15, 71, 72) of said two or more linear arrays, and
   a feed port (40, 41, 42, 43) at least at one end of each one of said first and second connecting units for reception of a feed signal.

2. The planar antenna array as defined in any preceding embodiment,
wherein said first connecting unit comprises a first connecting line (30) and said second connecting unit comprises a second connecting line (31).

3. The planar antenna array as defined in any preceding embodiment,
wherein said first connecting unit comprises a first linear connecting array (50) of radiation elements and said second connecting unit comprises a second linear connecting array (51) of radiation elements, said first and second linear connecting arrays being arranged substantially perpendicular to said two or more linear arrays.

4. The planar antenna array as defined in embodiment 3,
wherein said first and second linear connecting arrays comprise at least one radiation element (60) between each two neighboring linear arrays.

5. The planar antenna array as defined in any preceding embodiment,
comprising a feed port (40, 41, 42, 43) at each end of said first and second connecting units for reception of a feed signal.

6. The planar antenna array as defined in any preceding embodiment,
comprising three or more linear arrays (10, 11, 12, 13) of radiation elements,
wherein said first and second connecting units comprise connecting lines (81, 82, 83, 84) to connect the three or more linear arrays in a star topology.

7. The planar antenna array as defined in embodiment 6,
comprising interconnection lines (85, 86, 87) for interconnecting a first end of a linear array with a second end of the neighboring linear array.

8. The planar antenna array as defined in embodiment 2,
wherein the length (L1) of the connecting line portion (32) between two neighboring linear arrays is larger than the spacing (L2) between said two neighboring linear arrays.

9. The planar antenna array as defined in embodiment 2,
wherein the length (L1) of the connecting line portion (32) between two neighboring linear arrays is designed to determine the distribution of phase and/or amplitude values for said two neighboring linear arrays.

10. The planar antenna array as defined in any preceding embodiment,
wherein the spacing (L2) between two neighboring linear arrays (10, 11) is designed to determine the beam width, side lobes and/or directivity of the antenna beam of the antenna array.

11. The planar antenna array as defined in any preceding embodiment,
wherein the spacing (L3) between two neighboring radiation elements (20*a*, 20*b*) of a linear array is designed to determine the beam steering of the antenna beam of the antenna array in a direction parallel to the linear array.

12. The planar antenna array as defined in any preceding embodiment,
wherein said radiation elements (20, 60) are patch antenna elements, slot antenna elements, slotted waveguide element or substrate-integrated waveguide elements.

13. An antenna device comprising:
   a planar antenna array (1, 2, 3, 4, 5, 6) as defined in any preceding embodiment, and
   a signal source (101) for generating a feed signal and for providing said feed signal to said feed ports (40, 41, 42, 43).

14. The antenna device as defined in embodiment 13,
further comprising a controller (102) for controlling the providing of said feed signal to the respective feed ports and/or for switching the respective feed ports on and off.

15. The antenna device as defined in any preceding embodiment 13,
further comprising a variable phase shifter (103) between said signal source and at least one feed port to control the phase of the feed signal provided to the respective feed port.

16. The antenna device as defined in any preceding embodiment 13,
further comprising a variable phase shifter (103) between said signal source and each feed port to control the phase of the feed signal provided to the respective feed port.

17. The antenna device as defined in any preceding embodiment 15 or 16,
wherein said variable phase shifter (103) is configured to shift the phase of the feed signal by 0° or 180°.

18. The antenna device as defined in any preceding embodiment 15 or 16,
wherein said variable phase shifter (103) is configured to shift the phase of the feed signal to a shift value in the range from 0° to 360°.

19. The antenna device as defined in any preceding embodiment 17 or 18,
further comprising a controller (102) for controlling the variable phase shifter (103).

20. A method of operating an antenna array as defined in any preceding embodiment 1 to 12, said method comprising:
   generating a feed signal,
   providing said feed signal to one or more feed ports of said antenna array, thereby controlling to which of said feed ports the feed signal is provided and controlling the phase of the feed signal before providing it to said one or more feed ports.

The present application claims priority to European Patent Application 16 174 792.8, filed in the European Patent Office on Jun. 16, 2016, the entire contents of which being incorporated herein by reference.

The invention claimed is:

1. A planar antenna array comprising:
   three or more linear arrays of radiation elements, each linear array having a first end and a second end, and said linear arrays being substantially arranged in parallel,
   at least one first connecting unit and at least one second connecting unit connecting the first ends of said three or more linear arrays,
   at least one interconnecting line connecting the second end of at least one of the three or more linear arrays with the second end of a neighboring linear array, and one or more feed ports, wherein at least one end of each of said at least one first and said at least one second connecting units having one of the one of more feed ports for reception of a feed signal, wherein said at least one first and said at least one second connecting units, and said at least one interconnecting line connect the three or more linear arrays in a star topology in which all antenna elements of the three or more linear arrays are connected to at least one of the one or more feeding ports via the at least one first and the at least one second connecting units on the first ends, and are connected together via the at least one interconnecting line on the second ends.

2. The planar antenna array as claimed in claim 1, wherein said first connecting unit comprises a first connecting line and said second connecting unit comprises a second connecting line.

3. The planar antenna array as claimed in claim 1, comprising a feed port at each of said at least one first and said at least one second connecting units for reception of a feed signal.

4. The planar antenna array as claimed in claim 2, wherein the length of the interconnecting line between two neighboring linear arrays is larger than the spacing between said two neighboring linear arrays.

5. The planar antenna array as claimed in claim 2, wherein the length of the interconnecting line between two neighboring linear arrays is designed to determine the distribution of phase and/or amplitude values for said two neighboring linear arrays.

6. The planar antenna array as claimed in claim 1, wherein the spacing between two neighboring linear arrays is designed to determine the beam width, side lobes and/or directivity of the antenna beam of the antenna array.

7. The planar antenna array as claimed in claim 1, wherein the spacing between two neighboring radiation elements of a linear array is designed to determine the beam steering of the antenna beam of the antenna array in a direction parallel to the linear array.

8. The planar antenna array as claimed in claim 1, wherein said radiation elements are patch antenna elements, slot antenna elements, slotted waveguide element or substrate-integrated waveguide elements.

9. An antenna device comprising: the planar antenna array as claimed in claim 1, and a signal source for generating a feed signal and for providing said feed signal to said feed ports.

10. The antenna device as claimed in claim 9, further comprising a controller for controlling the providing of said feed signal to the respective feed ports and/or for switching the respective feed ports on and off.

11. The antenna device as claimed in claim 9, further comprising a variable phase shifter between said signal source and at least one feed port to control the phase of the feed signal provided to the respective feed port.

12. The antenna device as claimed in claim 9, further comprising a variable phase shifter between said signal source and each feed port to control the phase of the feed signal provided to the respective feed port.

13. The antenna device as claimed in claim 11, wherein said variable phase shifter is configured to shift the phase of the feed signal by 0° or 180°.

14. The antenna device as claimed in claim 11, wherein said variable phase shifter is configured to shift the phase of the feed signal to a shift value in the range from 0° to 360°.

15. The antenna device as claimed in claim 13, further comprising a controller for controlling the variable phase shifter.

16. A method of operating a planar antenna array, said planar antenna array including:

three or more linear arrays of radiation elements, each linear array having a first end and a second end, and said linear arrays being substantially arranged in parallel, at least one first connecting unit and at least one second connecting unit connecting the first ends of said three or more linear arrays, at least one interconnecting line connecting the second end of at least one of the three or more linear arrays with the second end of a neighboring linear array, and one or more feed ports, wherein at least one end of each of said at least one first and said at least one second connecting units having one of the one of more feed ports for reception of a feed signal, wherein said at least one first and said at least one second connecting units, and said at least one interconnecting line connect the three or more linear arrays in a star topology in which all antenna elements of the three or more linear arrays are connected to at least one of the one or more feeding ports via the at least one first and the at least one second connecting units on the first ends, and are connected together via at least one interconnecting line on the second ends, said method comprising:

generating said feed signal; and providing said feed signal to said one or more feed ports of said planar antenna array, thereby controlling to which of said one or more feed ports the feed signal is provided and controlling the phase of the feed signal before providing the feed signal to said one or more feed ports.

* * * * *